US008967437B2

(12) United States Patent
Wilson

(10) Patent No.: US 8,967,437 B2
(45) Date of Patent: Mar. 3, 2015

(54) ELECTRONIC DEVICE HOLDER

(75) Inventor: Scott H. Wilson, Chicago, IL (US)

(73) Assignee: Wimo Labs LLC, Chicago, IL (US)

( * ) Notice: Subject to any disclaimer, the term of this patent is extended or adjusted under 35 U.S.C. 154(b) by 456 days.

(21) Appl. No.: 13/344,375

(22) Filed: Jan. 5, 2012

(65) Prior Publication Data

US 2012/0168471 A1 Jul. 5, 2012

Related U.S. Application Data

(60) Provisional application No. 61/429,917, filed on Jan. 5, 2011.

(51) Int. Cl.

| | |
|---|---|
| ***A44C 5/14*** | (2006.01) |
| ***A44C 5/00*** | (2006.01) |
| ***A45F 5/00*** | (2006.01) |
| ***G04B 37/14*** | (2006.01) |

(52) U.S. Cl.

CPC ..... *A45F 5/00* (2013.01); *G04B 37/1486* (2013.01); *A45F 2005/008* (2013.01); *A45F 2200/0508* (2013.01)

USPC ..... 224/165; 224/152; 224/170; 224/180; 224/219; 224/222

(58) Field of Classification Search

CPC ..... A44C 5/00; A45F 2005/008

USPC ..... 224/165, 152, 219, 221, 222, 170, 180

See application file for complete search history.

(56) References Cited

U.S. PATENT DOCUMENTS

| | | | | |
|---|---|---|---|---|
| 2,136,625 A * | 11/1938 | Lasko | 368/316 |
| 2,188,471 A * | 1/1940 | Bridler | 224/170 |
| 4,135,805 A * | 1/1979 | Taylor et al. | 399/379 |
| 4,136,805 A * | 1/1979 | Storms | 224/219 |
| 4,266,400 A * | 5/1981 | Tabata | 59/35.1 |
| 5,008,864 A * | 4/1991 | Yoshitake | 368/10 |

(Continued)

FOREIGN PATENT DOCUMENTS

| | | |
|---|---|---|
| JP | 2009-268041 A | 11/2009 |
| KR | 20-0202216 Y1 | 11/2000 |
| KR | 10-0879543 B1 | 1/2009 |

OTHER PUBLICATIONS

Written Opinion of the International Searching Authority for PCT/US2012/020343, dated Aug. 30, 2012.

*Primary Examiner* — Justin Larson

*Assistant Examiner* — Lester L Vanterpool

(74) *Attorney, Agent, or Firm* — Neal, Gerber & Eisenberg LLP

(57) ABSTRACT

An electronic device holder having a retention member for retaining an electronic device, such as an MP3 player, preferably an Apple® IPod nano having a multi-touch color screen, and a strap or shank attached to the retention member to allow fastening to an object, such as a user's wrist or a chain, is disclosed. The device may be secured by friction fitting into a recessed area having two ridges to engage the device along two edges. The device may be inserted by sliding or snap fitting into the recessed area. An opening along the back of the recessed area allows the device to be pushed laterally or vertically from the retention member. Alternatively, the retention member may be a two-piece frame which partially encloses the device. The frame pieces affix to either a wristband strap or a carabiner clip shank as they are secured to one another.

20 Claims, 12 Drawing Sheets

(56) References Cited

U.S. PATENT DOCUMENTS

| | | | | |
|---|---|---|---|---|
| 5,274,613 | A * | 12/1993 | Seager | 368/13 |
| 6,158,884 | A * | 12/2000 | Lebby et al. | 368/282 |
| 6,360,928 | B1 * | 3/2002 | Russo | 224/218 |
| 6,459,890 | B1 * | 10/2002 | Kim | 455/351 |
| 6,549,791 | B1 * | 4/2003 | Jeon et al. | 455/572 |
| 6,726,070 | B2 * | 4/2004 | Lautner | 224/221 |
| 6,742,685 | B2 * | 6/2004 | Williams | 224/197 |
| 6,757,390 | B2 * | 6/2004 | Ito et al. | 379/433.1 |
| 6,880,737 | B2 * | 4/2005 | Bauer | 224/246 |
| 7,243,824 | B2 * | 7/2007 | Tabata | 224/222 |
| D548,457 | S * | 8/2007 | Reinerio | D3/218 |
| 7,296,752 | B2 * | 11/2007 | Carnevali | 235/462.44 |
| 7,334,711 | B1 * | 2/2008 | Winters | 224/217 |
| 7,424,110 | B1 * | 9/2008 | Whiten, III | 379/454 |
| 7,469,809 | B2 * | 12/2008 | Rodarte et al. | 224/578 |
| 7,529,155 | B2 * | 5/2009 | Fasciano | 368/10 |
| 7,764,488 | B2 * | 7/2010 | Calvarese | 361/679.03 |
| 8,140,131 | B1 * | 3/2012 | Green | 455/575.1 |
| 8,328,055 | B1 * | 12/2012 | Snyder | 224/197 |
| 8,534,514 | B2 * | 9/2013 | Zhu et al. | 224/165 |
| 8,616,423 | B2 * | 12/2013 | Wizikowski | 224/218 |
| 8,662,362 | B1 * | 3/2014 | Bastian et al. | 224/218 |
| 2003/0213822 | A1 * | 11/2003 | Lautner | 224/221 |
| 2005/0145657 | A1 * | 7/2005 | Norberg | 224/222 |
| 2007/0215663 | A1 * | 9/2007 | Chongson et al. | 224/930 |
| 2008/0017678 | A1 * | 1/2008 | Anderson et al. | 224/221 |
| 2009/0039121 | A1 * | 2/2009 | Paul | 224/222 |
| 2009/0044825 | A1 * | 2/2009 | Lawrence et al. | 132/295 |
| 2009/0321483 | A1 * | 12/2009 | Froloff | 224/267 |
| 2010/0192356 | A1 * | 8/2010 | Zadesky et al. | 29/592.1 |
| 2010/0327030 | A1 * | 12/2010 | Yang | 224/199 |

* cited by examiner

ELECTRONIC DEVICE HOLDER

RELATED APPLICATIONS

This application claims the Jan. 5, 2011 filing priority of U.S. Provisional Application No. 61/429,917, titled "Wristband," and hereby incorporates the same by reference.

TECHNICAL FIELD OF THE INVENTION

The present device relates to a holder for an electronic device. Particularly, the device relates to a wristband and a clip or lock, each of which retains the electronic device within a secure area. Most particularly, the present device relates to a wristband and a clip or lock for securing an MP3 player or the like.

BACKGROUND OF THE INVENTION

Wristwatches are becoming more and more scarce it seems, as people want more than time related features from their electronic devices. It isn't enough that a watch can tell time in different countries or languages. It isn't enough that a watch can act as an alarm, stop watch and timer, with the push of any number of different bezel-mounted buttons. With the advent of MP3 players, smart phones, smart pads and other wireless computing devices, the time for Dad's (or Grandpa's) multi-function wristwatch has passed.

People want multi-touch control. They want game, personal, and productivity applications at their fingertips. They want music with download capabilities. However, they also want elegance to go with all that functionality. The ability to remain feminine or masculine and stylish is a need that has gone unappreciated by those designers attempting to take advantage of the popularity of devices such as the Apple® IPod nano MP3 player. Belt clips, pocket clips and arm bands are neither elegant nor stylish, and are inconvenient to use because they require regular attachment and detachment.

Further, people want more from their electronic devices, such as MP3 players. It isn't enough to provide a housing with a clip for attaching to an article of clothing. The device must be capable of integration into a user's particular lifestyle, not just as a running/walking/exercise accessory. As the electronic device manufactures fail to fill this need, a holder for such devices becomes more imperative.

The present device solves these and other problems associated with prior art devices. The present device provides a beautifully aesthetic and completely functional means for carrying an MP3 player, such as the Apple® IPod nano, while allowing the user to have ready access to all the features of the player without the need for detaching and reattaching associated with most devices.

SUMMARY OF THE INVENTION

There is disclosed herein an improved holder for carrying an electronic device, such as an MP3 player (e.g., the Apple® IPod nano), which avoids many of the disadvantages of prior devices while affording additional structural and operating advantages.

Generally speaking, the holder comprises a retention member for retaining an MP3 player having a multi-touch screen, and a strap or clip attached to the retention member to allow fastening to any number of articles, including a user's wrist. The retention of the MP3 player within the retention member may be accomplished in a variety of ways.

In one embodiment, the holder is a wristband and the MP3 player is secured by friction fitting the player into a recessed area of the retention member. Two somewhat flexible ridges engage the player along two opposing edges. The player may be inserted through a face opening on the retention member or, alternately, the player may slide into place through a side opening. An opening on a back surface of the retention member allows the player to be pushed from the recessed area, if desired.

In another embodiment, the holder is a wristband and the retention member is comprised of a two-piece frame which at least partially encloses the MP3 player. The frame pieces affix to a wristband strap as they are secured to one another.

In still another embodiment, the holder is a lock with a two-piece retention member similar to that of the previously described embodiment. The clasp of the lock may include a carabiner clip to make frequent attachment and removal of the holder easier and quicker.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF PREFERRED EMBODIMENTS

Figure 1:
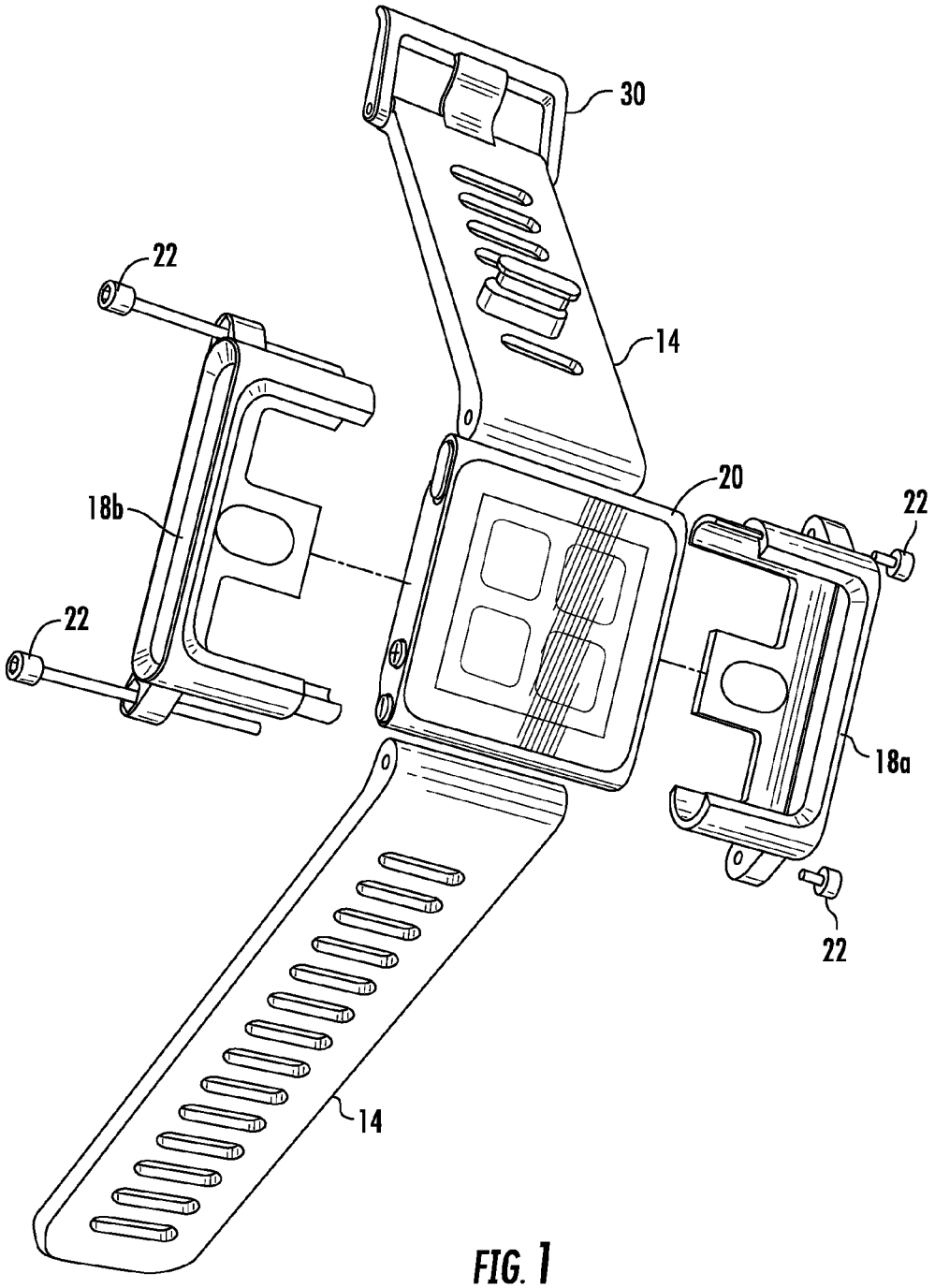
FIG. 1 is a front exploded view of an embodiment of the present device illustrating the capture and retention of an electronic device.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to embodiments illustrated. A full video disclosure of embodiments described herein can be seen at http://lunatik.com/, the contents of which are hereby incorporated by reference.

Referring to FIGS. 1-7, there is illustrated embodiments of a wristband, generally designated by the numeral 10. The wristband 10 has a retention member 12 and a strap 14 which allows attachment of the entire device to, preferably, a user's wrist. The retention member 12 retains an electronic device, such as an MP3 player 20, and preferably an Apple® IPod nano (6th generation) as shown, which then allows access to the functionality of the device as, for example, a wristwatch, a radio, a game console or the like. While the Apple® IPod nano is the only illustrated and the preferred electronic device for the disclosed embodiments, the wristband 10 is not limited to use with this device. It is anticipated that many other electronic devices may be readily adapted for mounting within the disclosed and claimed wristband with only slight modifications necessary.

For example, mobile phones, communication devices, calculators, heart/health monitors, GPS devices, analog/digital watches and countless other electronic gadgets may be configured to be worn within wristband 10. Only the retention member 12 need be adapted to the shape and controls of such gadgets. The retention member 12, in different embodiments, may provide one of either a quick and temporary retention of the device 20 or a more permanent retention, as desired by the user.

Figure 2:
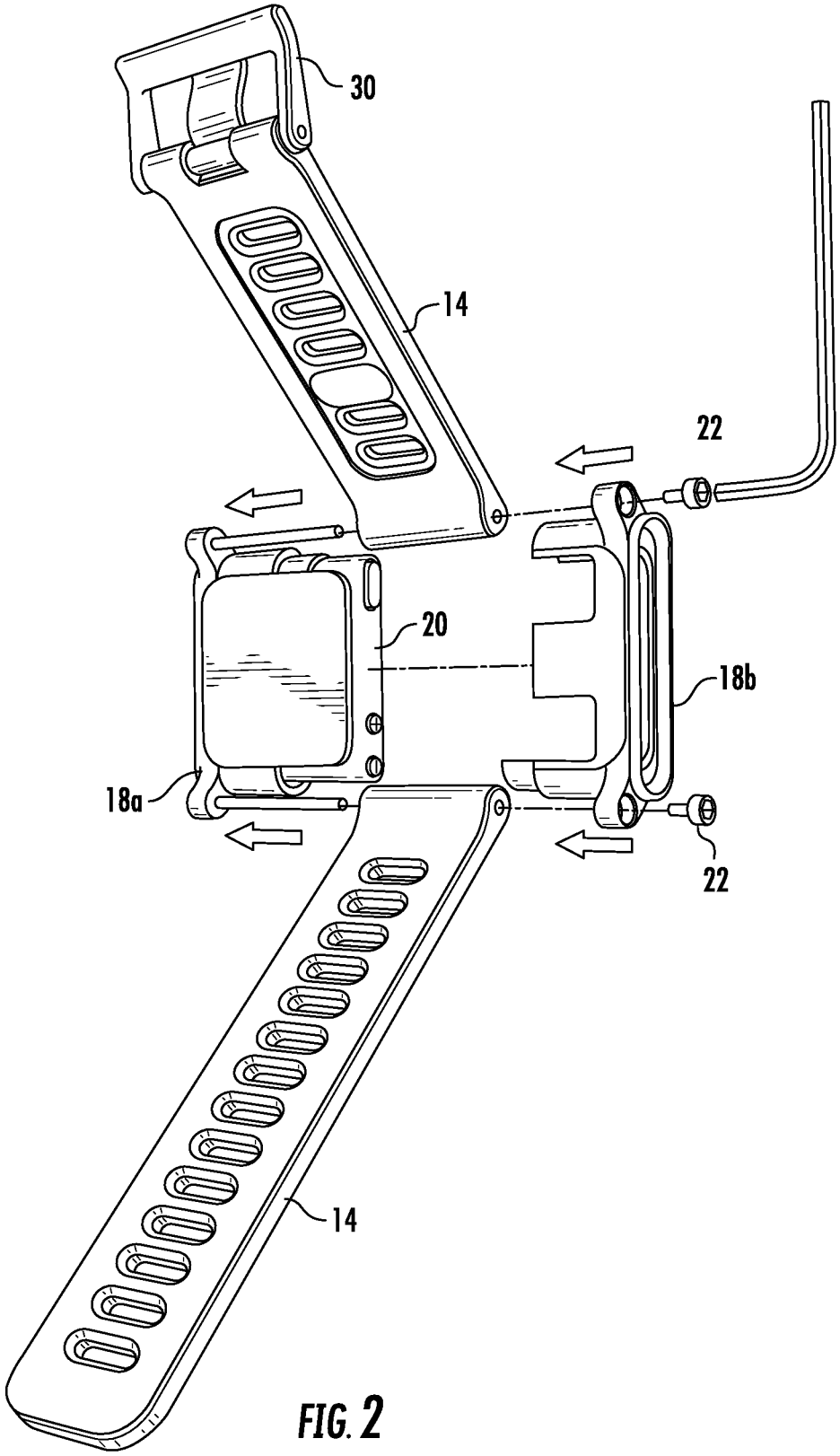
FIG. 2 is a rear exploded view of the embodiment of the present device shown in FIG. 1.
Figure 5:
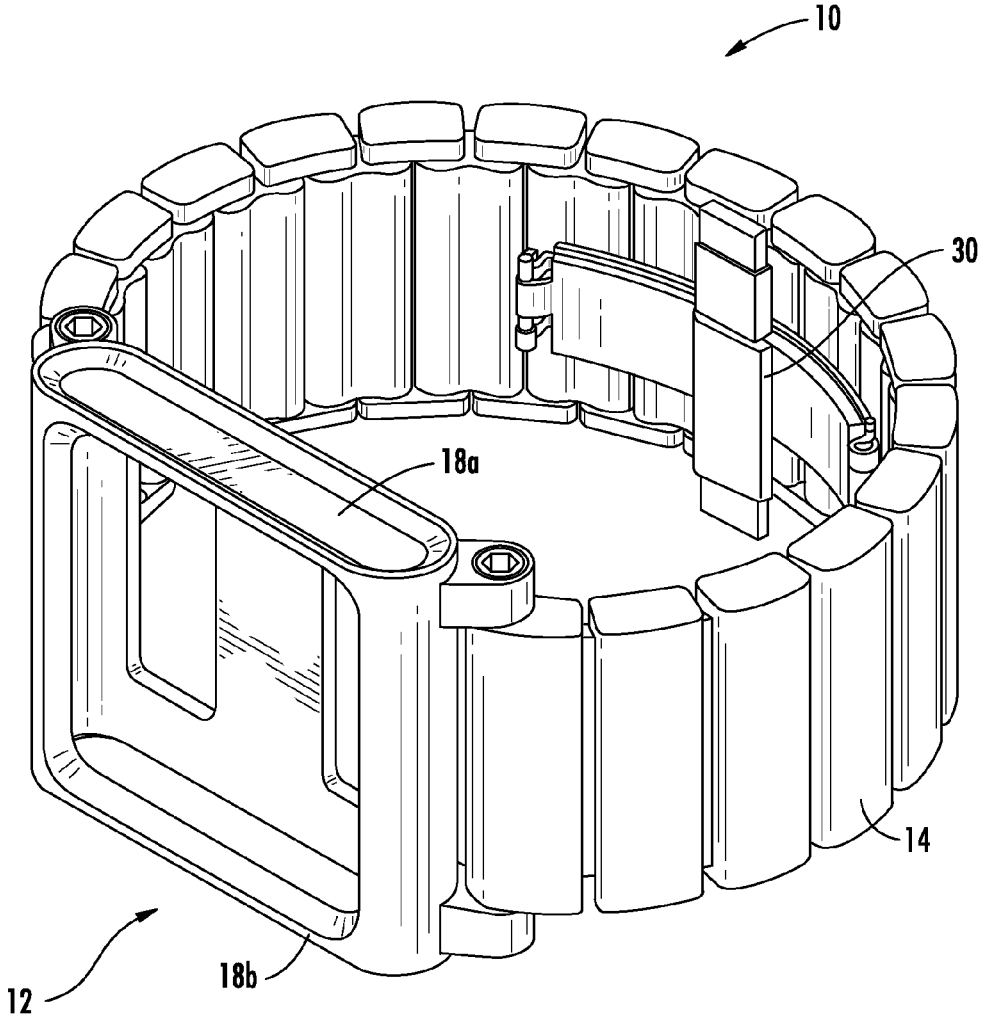
FIG. 5 is a perspective view of an embodiment similar to that of FIG. 3, except it includes a metal-link wristband.
Figure 6:
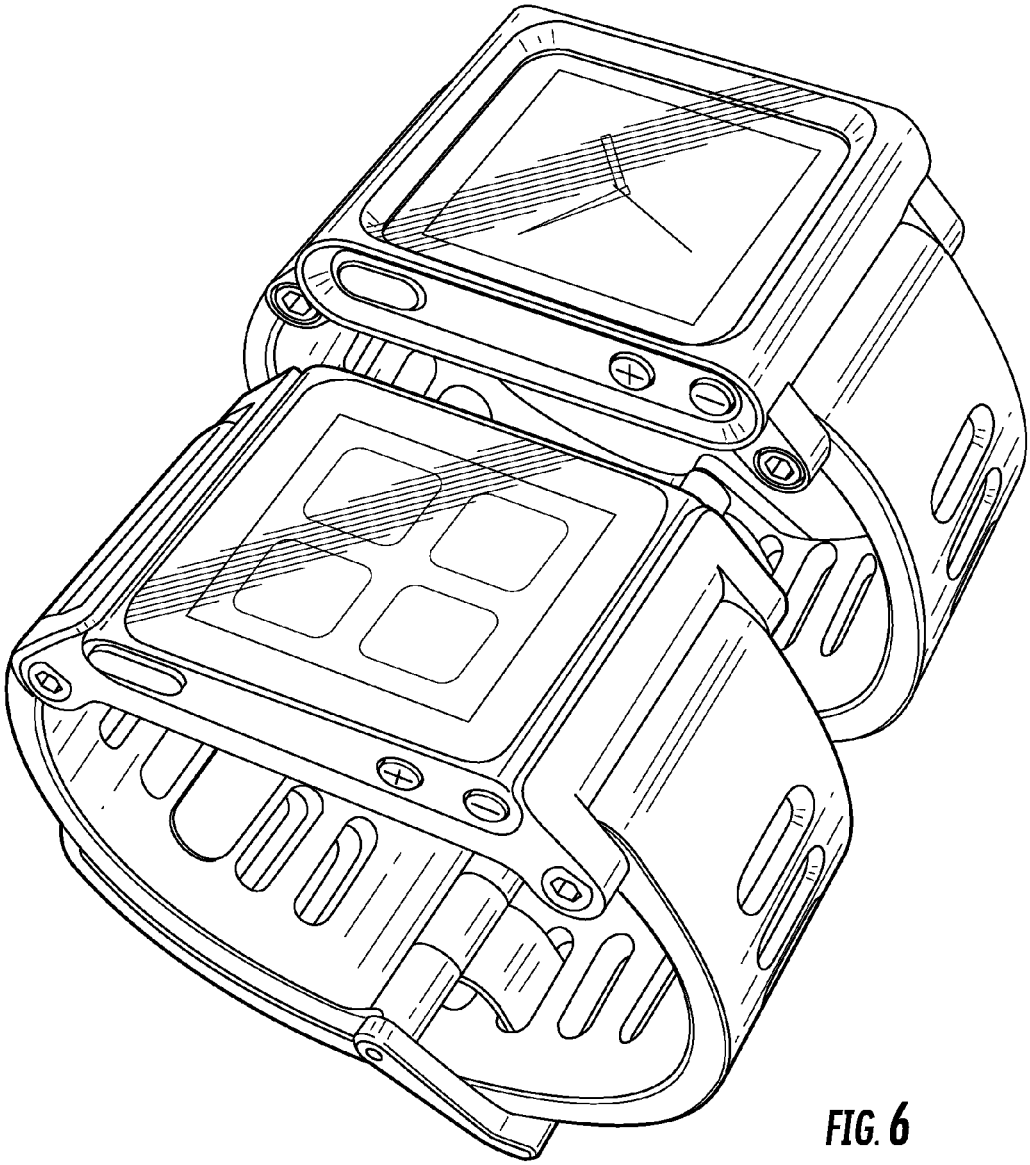
FIG. 6 is a perspective view of the embodiments of FIGS. 1 and 3 side-by-side.
Figure 7:
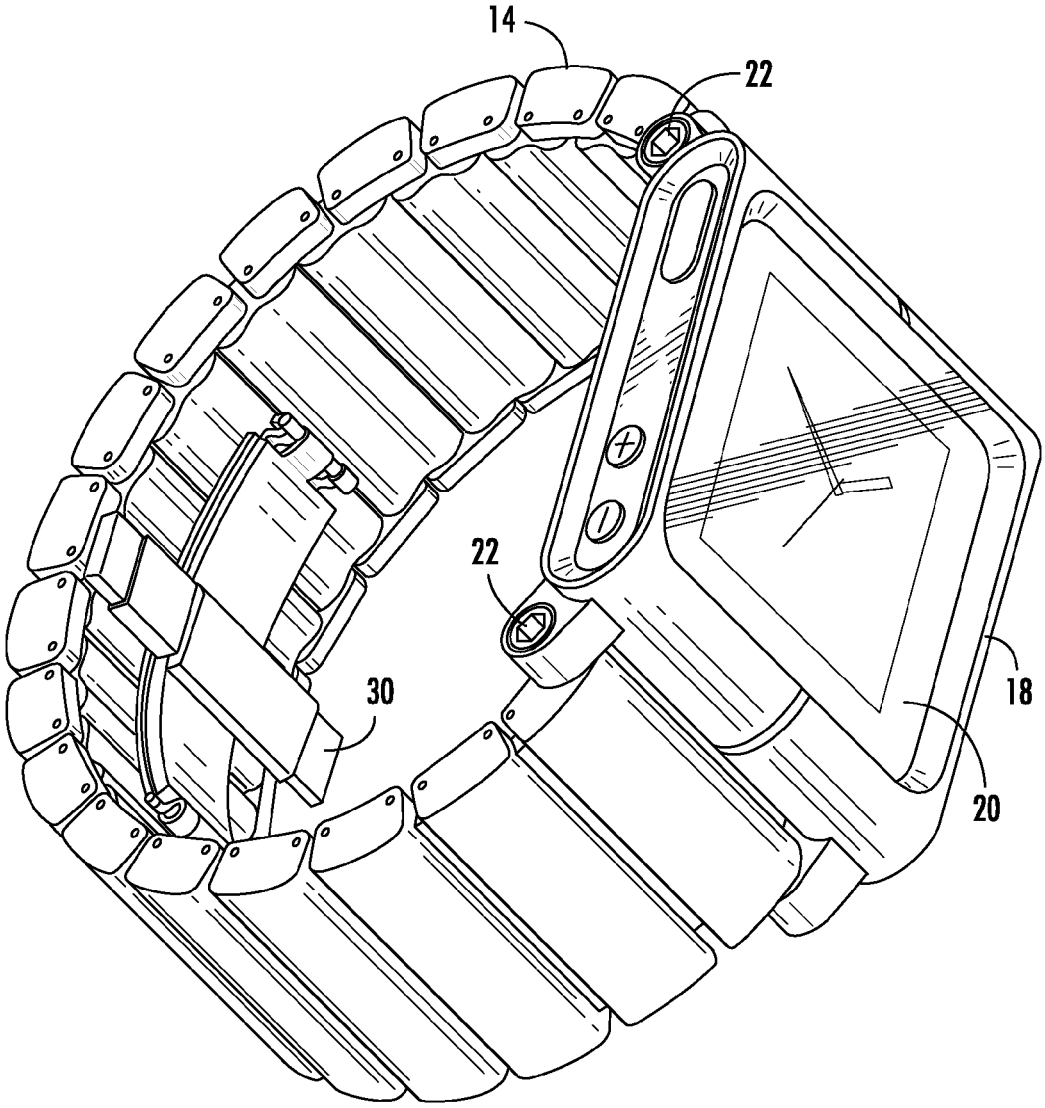
FIG. 7 is a perspective view of the embodiment of FIG. 5, including a seated MP3 player.

In the embodiments of FIGS. 1, 2 and 5, the retention member 12 is preferably comprised of a two-piece frame 18. Of course, while frames of more complex configurations may be used, the two-piece frame 18 illustrated provides a secure retention of the electronic device 20 with minimal obscuring of the user screen and button controls. The illustrated two-piece frame 18 is preferably forged from aerospace grade aluminum which is machined to a final form on a CNC machine. Of course, other materials and methods may provide suitable results for some applications. The preferred machined frame members have appropriate openings to provide access to both the screen, for viewing and touch-screen interface, and button controls. However, the aluminum components also encase the device 20 sufficiently to provide protection of the same screen and button controls, and protection against accidental detachment of the electronic device 20 as well.

The two frame members 18 *a, b* can be connected to one another after being placed about the player 20 by two pair of suitable threaded pins 22, as shown. The threaded pins 22 not only connect the two frame members 18 *a, b* together, but also pass through the strap ends to attach these to the retention member 12 as well. A unique aspect of the two-piece frame 18, as discernable in FIGS. 1 and 2, is that the two halves are identical. That is, the right half 18*a* is the same as the left half 18*b*, only rotated 180°. By using two identical pieces, much time and cost is saved in both manufacture and assembly of the retention member 12 in this embodiment. Further, in the event of loss or damage to one side, replacement can be made without having to "orphan" a mating side and without having to replace an undamaged or remaining side. The resulting retention member 12 is symmetrical top-to-bottom, as well as side-to-side.

Figure 3:
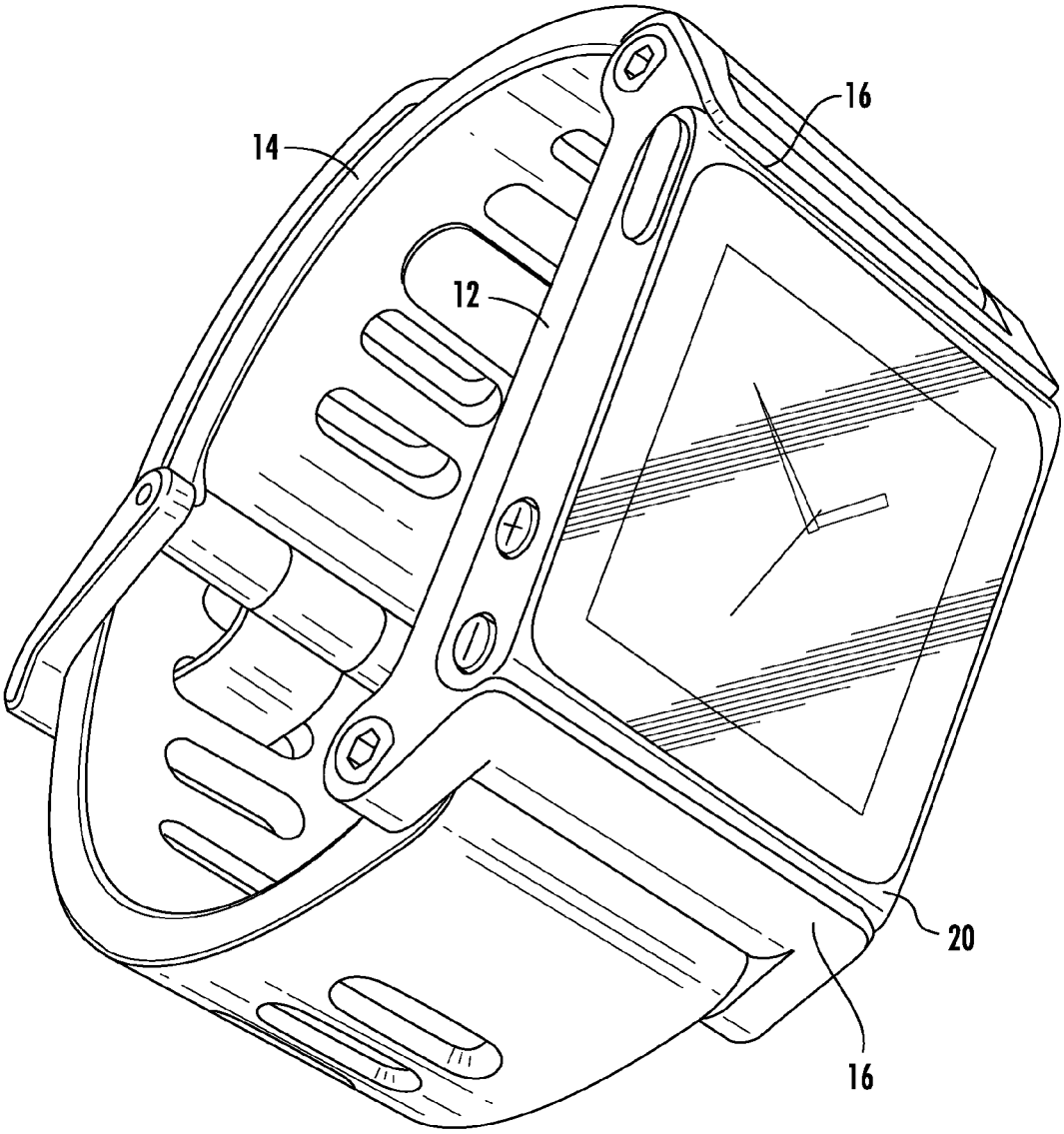
FIG. 3 is a front perspective of another embodiment of the present device illustrating the insertion of an electronic device.
Figure 4:
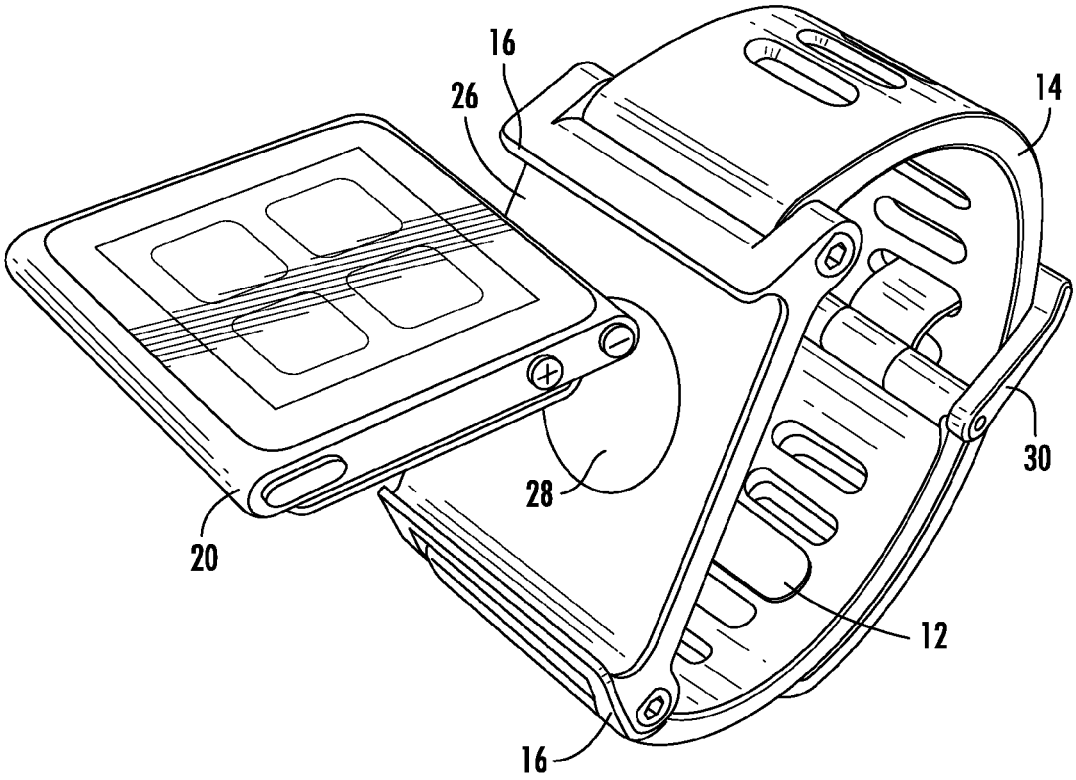
FIG. 4 is a front perspective of the embodiment of FIG. 3 showing the wristband with the electronic device detached.

In the embodiments of FIGS. 3 and 4, the retention member 12 is a simpler component, preferably made from a reinforced polycarbonate material. The retention member 12 is preferably comprised of a recessed area 26 defined by opposing surfaces of the retention member 12 and situated between two somewhat flexible ridges 16. The ridges 16 are contoured so as to engage the top and bottom sides of the electronic device 20, as shown.

The device 20 may be inserted into the recessed area 26 of the retention member in one of at least two ways. First, one of either the top or bottom edge of the device 20 is positioned in the recessed area 26 against one of the ridges 16. Then, the opposite end of the device 20 is pivoted down into the recessed area 26 until the edge snaps into place against the other ridge 16. Second, the device 20 can be slid from the side of the retention member 12 under the ridges 16 until it is properly seated in the recessed area 26. Again, the device 20 is frictionally held in place. An opening 28 in a back surface of the recessed area 26 of the retention member 12 allows the user to push the device 20 from the recessed area 26 when it is desired to remove the device 20. The opening 28 may also align with a product logo on the device 20, so as to clearly display the logo when the wristband 10 is not being worn. Otherwise, the two ridges 16 secure and retain the device 20 within the retention member 12.

The strap 14 in two of the disclosed embodiments (FIGS. 1 and 3) is preferably manufactured from a soft, silicone rubber material to provide the proper strength, comfort and look of a sporty or casual watchband. Again, other materials, such as polymers, leathers, metals, synthetic fabrics and the like, as well as alternate colors and styles may be used for different applications and designs. The strap 14 is also preferably a two-piece construction for adjustability, with a clasp 30 for connecting the two parts about a user's wrist. The clasp 30 is preferably made from forged, stainless steel.

The strap 14 of the embodiment of FIG. 5 is a more elegant and traditional watchband look. It is comprised of aluminum links connected together via a butterfly clasp 30. Again, the specific material (e.g., gold, silver, platinum, etc.) and finish of the metal-link band may be altered for different applications and designs. Certainly other styles for strap 14 not specifically mentioned herein are possible.

Referring to FIGS. 8-12, there is illustrated an embodiment of the electronic device holder as a lock and/or clip, which is generally designated by the numeral 110. The lock 110 has a retention member 112 and a generally U-shaped shank 114 which allows attachment of the entire device to, for example, a chain, a locker, a backpack or the like. Much like the watchband embodiments, the retention member 112 retains an electronic device, such as an MP3 player 20, and preferably an Apple® IPod nano (6th generation) as shown, which then allows access to the functionality of the device as, for example, a wristwatch, a radio, a game console or the like. While the Apple® IPod nano is the only illustrated and the preferred electronic device for the disclosed embodiments, the lock 110 is not limited to use with this device. It is anticipated that many other electronic devices may be readily adapted for mounting within the disclosed and claimed lock with only slight modifications necessary.

The retention member 112 of the lock 110 is preferably comprised of a two-piece frame 118. Of course, while frames of more complex configurations may be used, the two-piece frame 118 illustrated provides a secure retention of the electronic device 20 with minimal obscuring of the user screen and button controls. The illustrated two-piece frame 118 is preferably forged from aerospace grade aluminum which is machined to a final form on a CNC machine. Of course, other materials and methods may provide suitable results for some applications. The preferred machined frame members have appropriate openings to provide access to both the screen, for viewing and touch-screen interface, and button controls. However, the aluminum components also encase the device 20 sufficiently to provide protection of the same screen and button controls, and protection against accidental detachment of the electronic device 20 as well. The two frame members 118 *a, b* can be connected to one another after being placed about the player 20 by two suitable threaded pins 122, as shown.

The U-shaped shank 114, also preferably forged from aerospace grade aluminum, includes a carabiner clip 115 at one end. The two ends of the shank 114 have threaded openings which allow the pins 122 to secure each end of the shank to the retention member 112. However, the design, shape and material of the shank 114 may be changed to suit specific applications.

Figure 8:
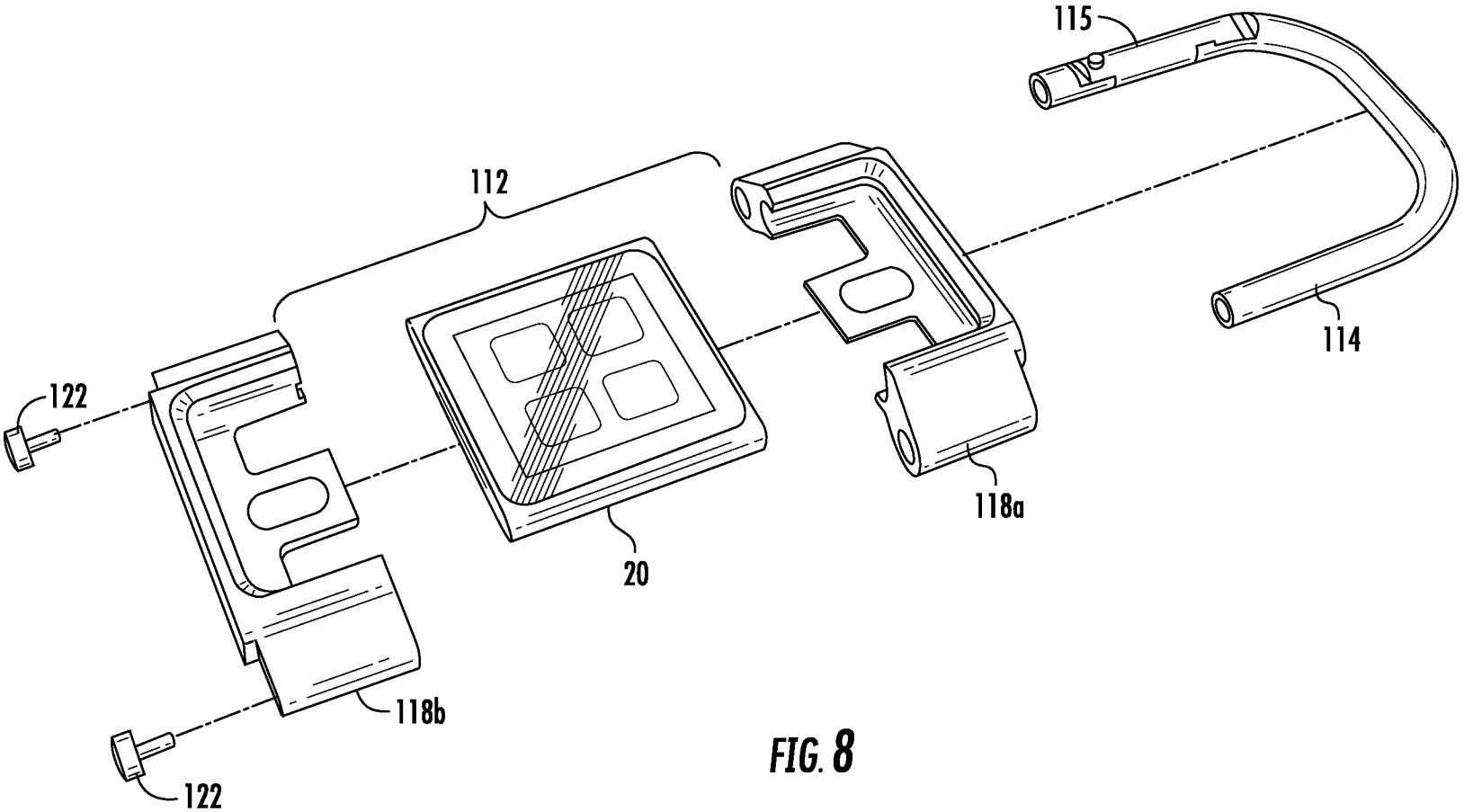
FIGS. 8-12 are various views of a third embodiment of an electronic device holder.
Figure 9:
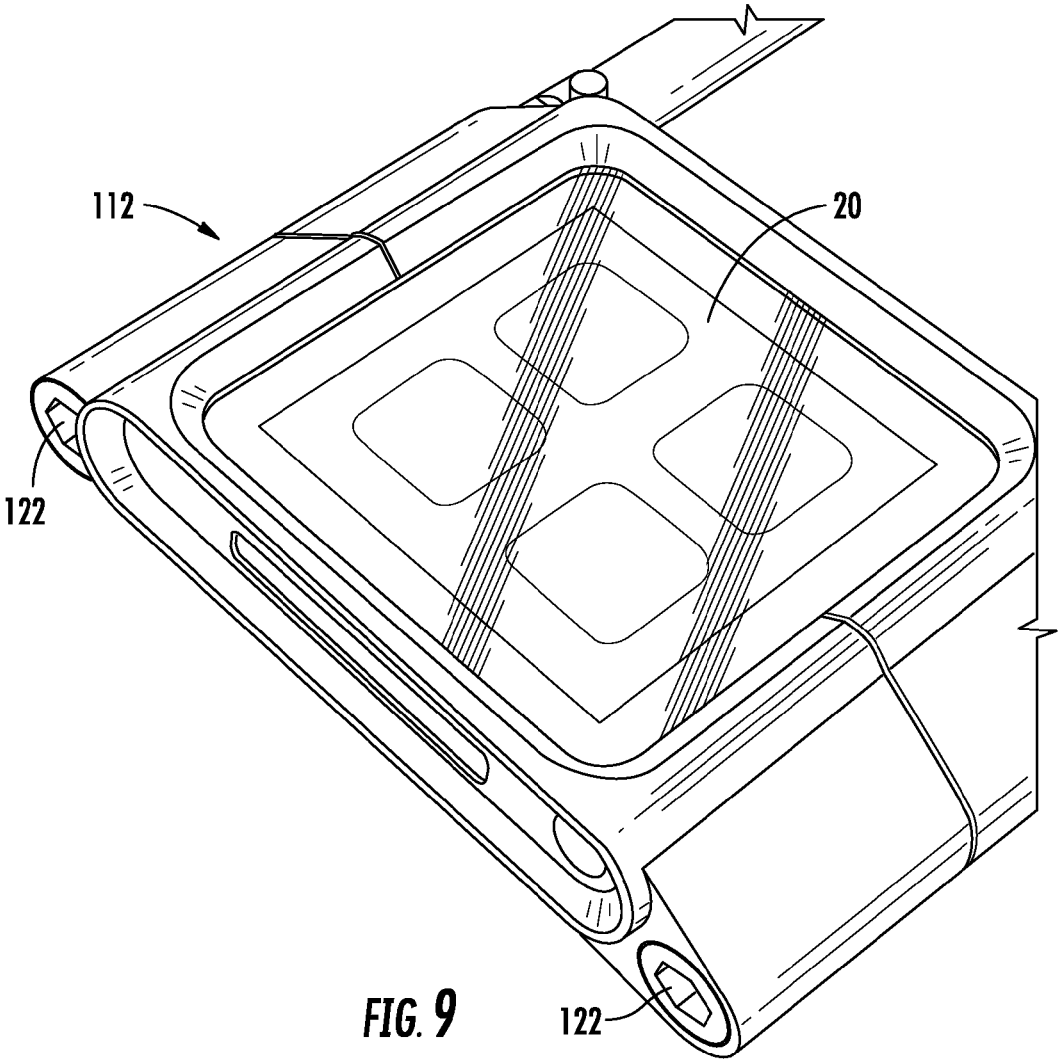
Figure 10:
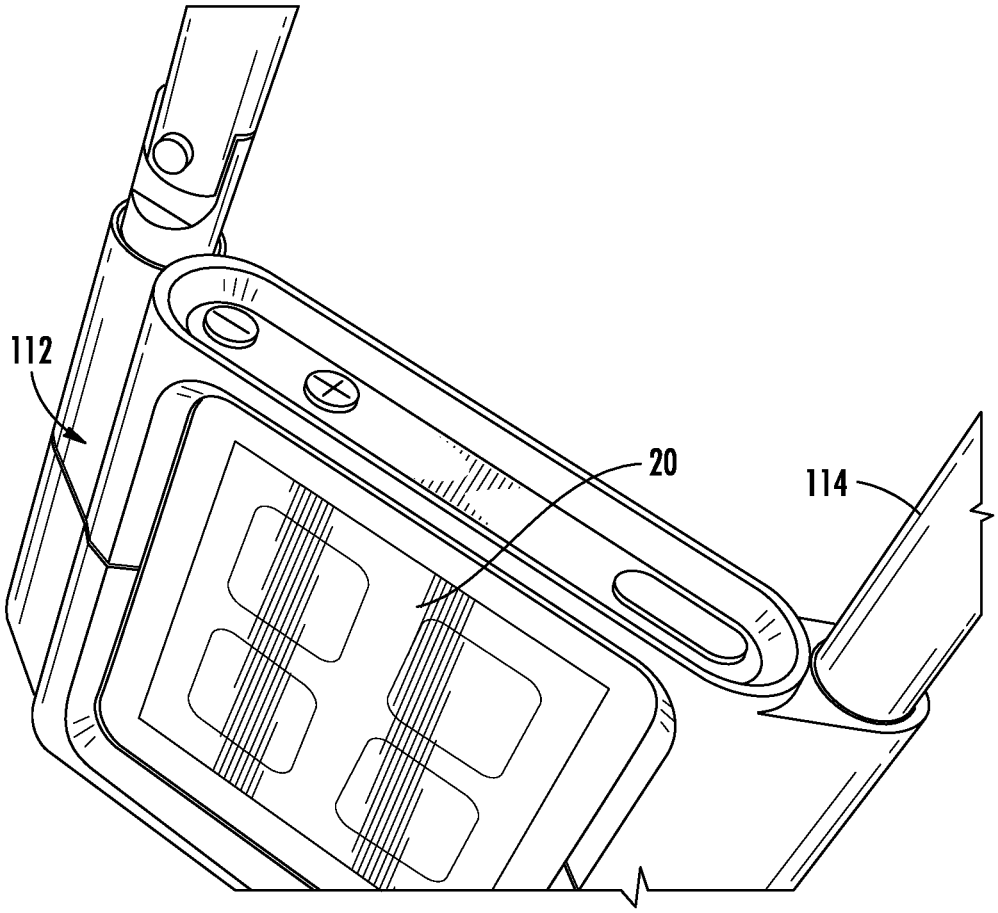
Figure 11:
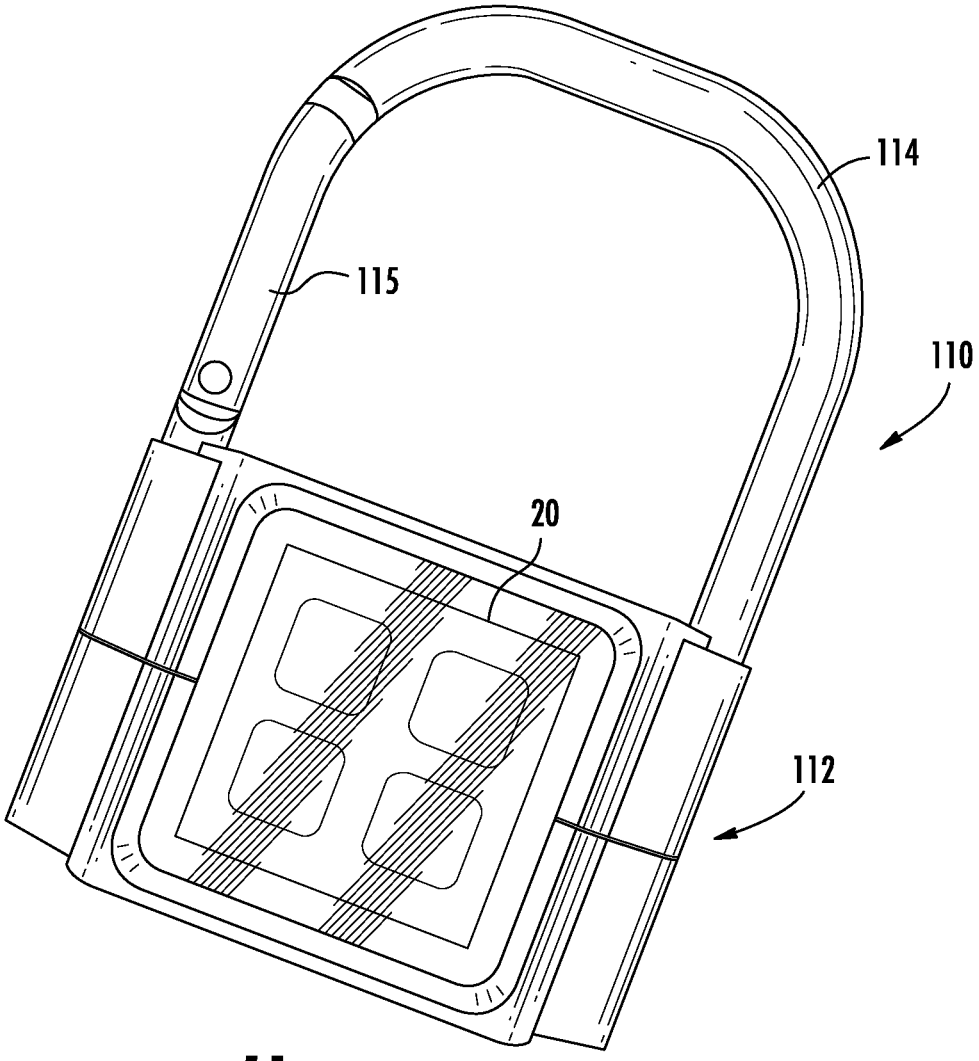
Figure 12:
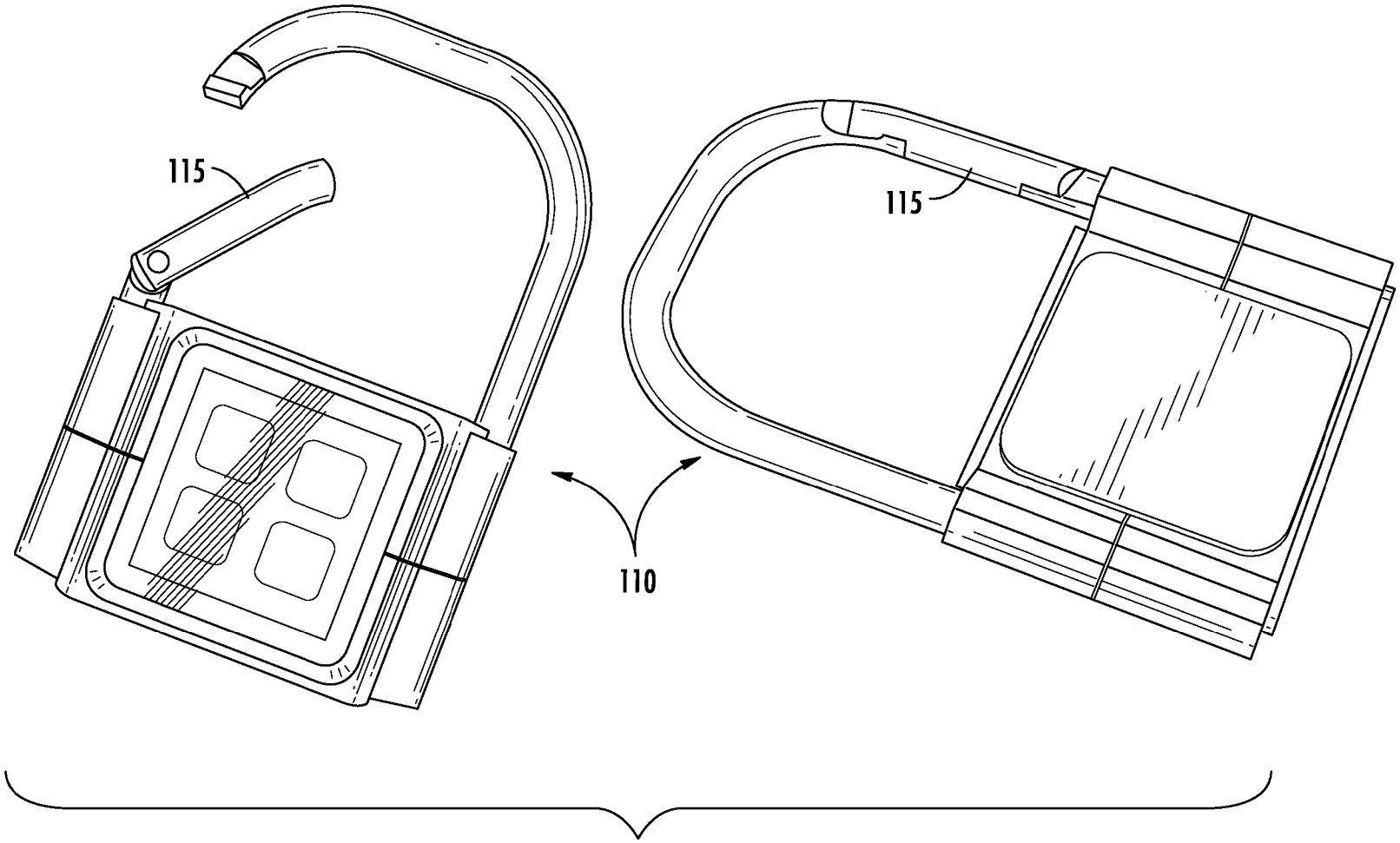

A unique aspect of the two-piece frame 118, as discernable in FIG. 8, is that the two halves are identical. That is, the top half 118*a* is the same as the bottom half 118*b*, only rotated 180°. By using two identical pieces, much time and cost is saved in both manufacture and assembly of the retention member 112 in this embodiment. Further, in the event of loss or damage to one side, replacement can be made without having to "orphan" a mating side and without having to replace an undamaged or remaining side. The resulting retention member 112 is symmetrical top-to-bottom, as well as side-to-side.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A wearable casing for supporting a digital electronic device, the casing comprising:

a first strap component having a proximal end and a distal end;

a second strap component having a proximal end and a distal end, the distal end comprising a clasp for attaching to a portion of the first strap component;

a first housing element comprising:

a top wall configured to at least partially surround a top side of the digital electronic device, the top wall having a second strap retaining extension;

a bottom wall configured to at least partially surround a bottom side of the digital electronic device, the bottom wall having a first strap retaining extension;

a side wall configured to at least partially surround a first side of the digital electronic device; and a backing portion configured to at least partially surround a back side of the digital electronic device; and a second housing element comprising:

a top wall configured to at least partially surround a top side of the digital electronic device, the top wall having a second strap retaining extension;

a bottom wall configured to at least partially surround a bottom side of the digital electronic device, the bottom wall having a first strap retaining extension;

a side wall configured to at least partially surround a second side of the digital electronic device; and a backing portion configured to at least partially surround a back side of the digital electronic device;

wherein the first housing element and the second housing element slide together around at least a portion of the digital electronic device, thereby forming a housing for the digital electronic device, securing the proximal ends of the first strap component between the first strap retaining extensions, and securing the proximal ends of the second strap component between the second strap retaining extensions.

2. The wearable casing of claim 1, wherein the first housing element and the second housing element are identical in shape and dimension.

3. The wearable casing of claim 1, wherein, when the first housing element and the second housing element are slid together around at least a portion of the digital electronic device, the backing portion of the first housing element and the backing portion of the second housing element collectively forming an extrication hole through which a portion of the back side of the digital electronic device is exposed.

4. The wearable casing of claim 3, wherein the extrication hole is sized to allow a user to insert a finger to assist with extricating the digital electronic device from the wearable casing.

5. The wearable casing of claim 2, wherein at least one of the top wall, the bottom wall, or the side wall of either the first housing element or the second housing element is configured to at least partially overlap a top face of the digital electronic device.

6. The wearable casing of claim 2, wherein at least one of the top wall, the bottom wall, or the side wall of either the first housing element or the second housing element provides an opening for access to a control feature of the digital electronic device positioned along the top side, bottom side, first side or second side of the digital electronic device.

7. The wearable casing of claim 2, further comprising:

a top pin extending through the second strap retaining extension of the first housing element, through a hole in the proximal end of the second strap component, and through the second strap retaining extension in the second housing element; and a bottom pin extending through the first strap retaining extension of the first housing element, through a hole in the proximal end of the first strap component, and through the first strap retaining extension in the second housing element.

8. The wearable casing of claim 7, wherein the top pin and the bottom pin have threaded ends and may be rotated by a tool to draw the first and second housing elements together around the digital electronic device so as to secure the digital electronic device to the first and second strap components.

9. The wearable casing of claim 1, further comprising:

a plurality of slots positioned between the proximal end and the distal end of the first strap component; and a post protruding from between the proximal end and the distal end of the second strap component.

10. The wearable casing of claim 9, wherein the clasp attaches to a first of the plurality of slots and the post extends through a second of the plurality of slots, and wherein the second of the plurality of slots is closer to the distal end of the first strap component than is the first of the plurality of slots.

11. A wearable casing for supporting a digital electronic device, the casing comprising:

a first housing element comprising:

a top wall configured to at least partially surround a top side of the digital electronic device;

a bottom wall configured to at least partially surround a bottom side of the digital electronic device;

a side wall configured to at least partially surround a first side of the digital electronic device; and a backing portion configured to at least partially surround a back side of the digital electronic device;

a second housing element comprising:

a top wall configured to at least partially surround a top side of the digital electronic device;

a bottom wall configured to at least partially surround a bottom side of the digital electronic device;

a side wall configured to at least partially surround a second side of the digital electronic device; and a backing portion configured to at least partially surround a back side of the digital electronic device;

a bottom pin extending through a bottom pin extension of the first housing element and through a bottom pin extension in the second housing element; and a top pin extending through a top pin extension of the first housing element and through a top pin extension in the second housing element;

wherein the top pin and the bottom pin secure the first housing element and the second housing element around at least a portion of the digital electronic device to form a housing for the digital electronic device.

12. The wearable casing of claim 11, wherein the first housing element and the second housing element are identical in shape and dimension.

13. The wearable casing of claim 11, further comprising:

a first strap component having a proximal end and a distal end, the proximal end fitting between the bottom pin extension of the first housing element and the bottom pin extension of the second housing element and comprising a hole through which the bottom pin extends; and a second strap component having a proximal end and a distal end, the distal end comprising a clasp for attaching to a portion of the first strap component, and the proximal end fitting between the top pin extension of the first housing element and the top pin extension of the second housing element and comprising a hole through which the top pin extends.

14. The wearable casing of claim 11, wherein, when the first housing element and the second housing element are slid together around at least a portion of the digital electronic device to form a housing for securing the digital electronic device, the backing portion of the first housing element and the backing portion of the second housing element collectively forming an extrication hole through which a portion of the back side of the digital electronic device is exposed.

15. The wearable casing of claim 14, wherein the extrication hole is sized to allow a user to insert a finger to assist with extricating the digital electronic device from the wearable casing.

16. The wearable casing of claim 11, wherein at least one of the top wall, the bottom wall, or the side wall of either the first housing element or the second housing element is configured to at least partially overlap a top face of the digital electronic device.

17. The wearable casing of claim 11, wherein at least one of the top wall, the bottom wall, or the side wall of either the first housing element or the second housing element provides an opening for access to a control feature of the digital electronic device positioned along the top side, bottom side, first side or second side of the digital electronic device.

18. The wearable casing of claim 13, wherein the top pin and the bottom pin have threaded ends and may be rotated by a tool to draw the first and second housing elements together around the digital electronic device so as to secure the digital electronic device to the first and second strap components.

19. The wearable casing of claim 13, further comprising:

a plurality of slots positioned between the proximal end and the distal end of the first strap component; and a post protruding from between the proximal end and the distal end of the second strap component.

20. The wearable casing of claim 19, wherein the clasp attaches to a first of the plurality of slots and the post extends through a second of the plurality of slots, and wherein the second of the plurality of slots is closer to the distal end of the first strap component than is the first of the plurality of slots.

* * * * *